US005490547A

United States Patent [19]

Abadi et al.

[11] Patent Number: 5,490,547

[45] Date of Patent: Feb. 13, 1996

[54] SYSTEM FOR PROVIDING A SUPPLY OF CHILLED FLUID

[76] Inventors: Meyer Abadi, Abanico a Maturin, Edificio Optipro #19, Parraquia, Altagracia, Caracas; Ernesto Hueso, Av. Sucre de los Dos Caminos, Edificio Yutaje, Apto. A-214, Caracas, both of Venezuela

[21] Appl. No.: 289,438

[22] Filed: Aug. 12, 1994

[51] Int. Cl.[6] ..... B65B 3/00

[52] U.S. Cl. ..... 141/359; 141/21; 141/82; 141/83; 62/188; 62/339

[58] Field of Search ..... 141/21, 82, 83, 141/351, 358, 359, 198; 62/338, 339, 188, 337; 221/150 R; D20/4, 5; D15/79–81, 89–91

[56] References Cited

U.S. PATENT DOCUMENTS

| | | | |
|---|---|---|---|
| 2,066,169 | 12/1936 | Zwosta . | |
| 2,103,479 | 12/1937 | Magee | 62/338 X |
| 2,359,780 | 10/1944 | Muffly . | |
| 2,407,058 | 9/1946 | Clum . | |
| 2,894,377 | 7/1959 | Shikles, Jr. et al. | 62/339 X |
| 3,128,914 | 4/1964 | Bertrand . | |
| 3,306,382 | 2/1967 | Espenschied et al. | 141/359 X |
| 3,335,807 | 8/1967 | Tytus | 177/79 |
| 3,398,805 | 8/1968 | Waller | 141/83 X |
| 3,411,554 | 11/1968 | Wilson | 141/351 |
| 3,566,613 | 3/1971 | Kinney | 62/130 |
| 3,638,392 | 2/1972 | Welker, Jr. et al. | 141/82 X |
| 3,719,308 | 3/1973 | Buchtel et al. . | |
| 3,827,256 | 8/1974 | Wiesner | 62/338 X |
| 3,934,757 | 1/1976 | Malek et al. | 62/339 |
| 3,969,909 | 7/1976 | Barto | 62/179 |
| 4,027,499 | 6/1977 | Barto | 62/340 |
| 4,738,285 | 4/1988 | Belland | 141/198 X |
| 4,911,212 | 3/1990 | Burton | 141/82 X |
| 5,148,841 | 9/1992 | Graffin | 141/83 |

*Primary Examiner*—J. Casimer Jacyna
*Attorney, Agent, or Firm*—Cushman Darby & Cushman

[57] ABSTRACT

A system for providing a constant supply of chilled fluid that includes a refrigerator cabinet having a refrigerated food storage area and a door. A serving vessel is removably located within the refrigerated food storage area. Fluid stored in the serving vessel is chilled while the serving vessel is in the refrigerated food storage area. The serving vessel also permits the fluid to be conveniently transported outside the refrigerated food storage area. A fluid supply system provides the fluid to the serving vessel via a dispenser located in the food storage area in response to outputs from devices that sense whether the door is closed, whether the serving vessel is at a specific location in the food storage area, and whether the amount of fluid is below a predetermined amount.

13 Claims, 4 Drawing Sheets

SYSTEM FOR PROVIDING A SUPPLY OF CHILLED FLUID

BACKGROUND OF THE INVENTION

1. Field of the Invention

The present invention relates to a system for providing a supply of chilled fluid and, more particularly, to a system wherein a serving vessel is removably positioned in a refrigerated chamber and automatically filled with fluid when located within the refrigerated chamber so that a supply of chilled fluid is available in the serving vessel.

2. Description of the Related Art

Many models of household refrigerators have ice and chilled water dispenser units located on the refrigerator or freezer door. The ice dispenser provides ice into a glass or the like positioned under the ice dispenser. The chilled water dispenser provides cold water directly into a glass positioned under the water dispenser. These features enable a user to fill a glass with ice and/or chilled water directly from the refrigerator without opening the refrigerator or freezer door. A disadvantage associated with such a chilled water dispensing system is that it does not permit a large quantity of chilled water to be readily available. That is, only one glass at a time can be filled from the refrigerator door. Furthermore, because the average flow rate of the water from the dispenser is 2 liters/minute, it takes seven seconds to fill an average drinking glass. Thus, it can take a considerable amount of time to fill a large number of glasses and, consequently, a relatively large supply of readily transportable fluid not provided by that system.

In order to have a large supply of chilled drinking water on hand, it is also known to fill a large jar or pitcher with water from, for example, the kitchen sink or even the chilled water dispenser, and place the filled pitcher inside the refrigerated chamber. This has an advantage over the above-described ice/chilled water dispenser in that a relatively large quantity of chilled water is readily available so that a large number of glasses can be filled more rapidly than if each glass was filled individually using the chilled water dispenser. Furthermore, the pitcher of water can be easily transported or carried away from the refrigerator and located, for example, on a dining room table so that chilled water can be dispensed therefrom while dining, without the burden of having to return to the refrigerator door for chilled water.

A disadvantage with such a system for providing a supply of chilled water is that it requires constantly monitoring the water level in the pitcher to ensure that an adequate supply of chilled water is available. It also requires manually refilling the pitcher each time the water level falls below a desired level. Oftentimes the user will forget to keep track of the volume of water in the pitcher and, as a result, will not have a sufficient supply of chilled water. Furthermore, the water pitcher used in this system takes up valuable shelf space in the refrigerator.

To avoid running out of chilled water, it is know to keep several pitchers of water in the refrigerator. However, this has the obvious disadvantage in that it uses up even more refrigerator space than if only one pitcher is employed. In addition, the water in the pitchers can lose its freshness after standing in the refrigerator over an extended period of time.

SUMMARY OF THE INVENTION

It is an object of the present invention to provide a system for providing a supply of chilled fluid that overcomes the problems associated with the above-identified fluid supply systems.

In accordance with the principles of the present invention, the foregoing object is achieved by providing a serving vessel removably located within a refrigerated chamber. A fluid supply system provides fluid to the serving vessel, as needed, when it is located within the refrigerated chamber. The serving vessel is sized such that a user is able to remove the serving vessel from within the refrigerated chamber conveniently and dispense the liquid therefrom. Because the fluid supply system refills the serving vessel when it is in the refrigerated chamber, a substantially constant and relatively large supply of chilled fluid is available to the user without constantly manually refilling water jars and replacing them in the refrigerated chamber.

Other objects, features, and characteristics of the present invention, as well as the methods of operation and the functions of the related elements of structure, and the economies of manufacture, will become more apparent upon consideration of the foregoing description and the appended claims with reference to the accompanying drawings, all of which form a part of the specification, wherein like reference numerals designate corresponding parts of the various figures.

DETAILED DESCRIPTION OF THE PRESENTLY PREFERRED EXEMPLARY EMBODIMENTS

Figure 1:
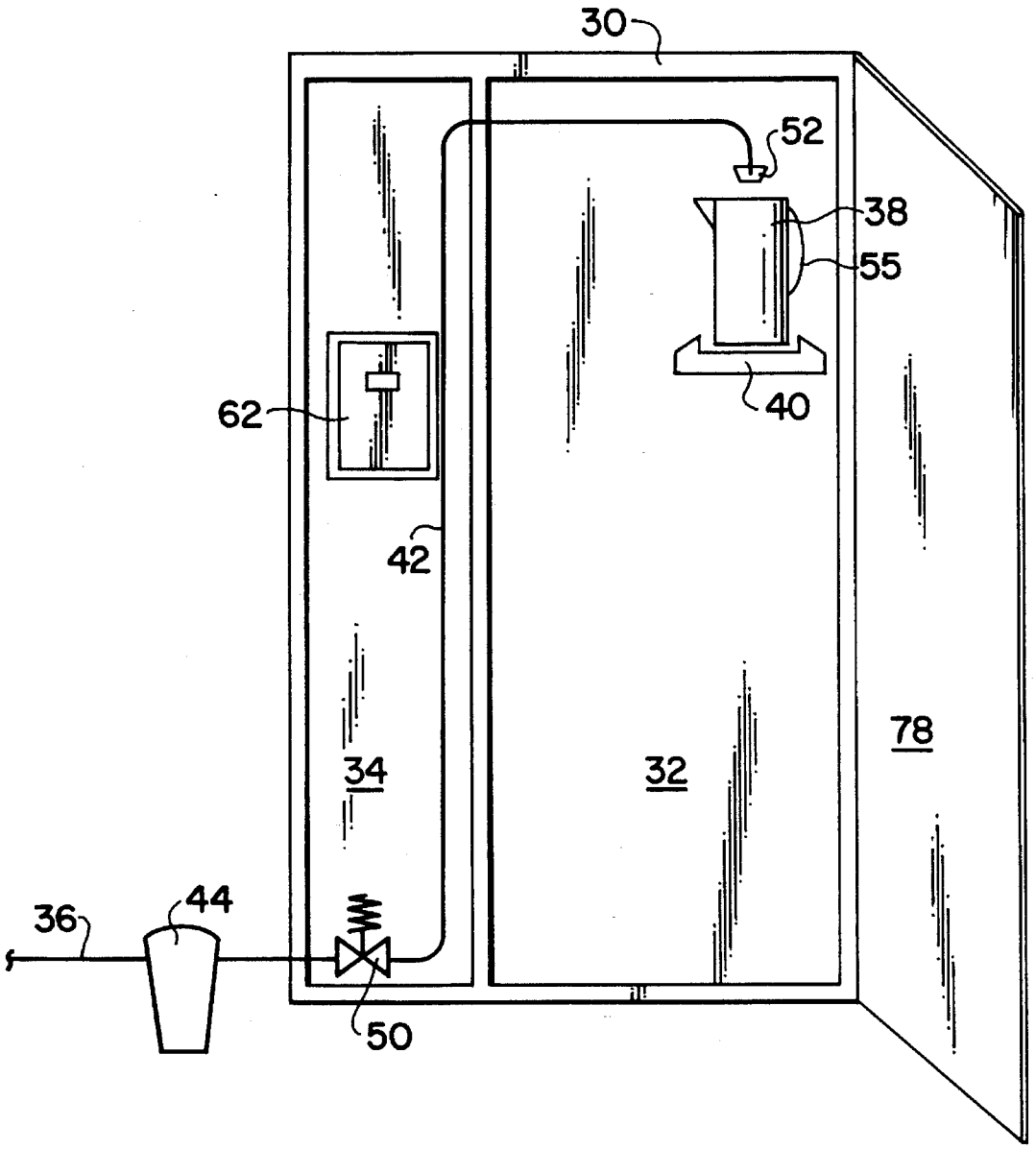
FIG. 1 is a front view of one embodiment of a system for providing a supply of chilled fluid according to the principles of the present invention.

FIG. 1 illustrates a system that provides a supply of chilled fluid, and in particular a supply of chilled drinking water, according to one embodiment of the present invention. The system illustrated in FIG. 1 includes a refrigerator cabinet 30 having a refrigerated chamber 32 therein. Refrigerator cabinet 30 also has a freezer chamber 34. Water is provided to refrigerator cabinet 30 from a water main 36, which is connected to an independent water supply, such as city water or a well.

A serving vessel 38, is located within refrigerated chamber 32 on a receiving pod 40. A fluid supply system provides water from the water source, which in the illustrated embodiment is water main 36, to serving vessel 38. The fluid supply system includes a fluid conduit 42, which is connected at one end to the fluid supply and which dispenses fluid from the other end into serving vessel 38. In the illustrated embodiment, the water within water main 36 is pressurized, and the water pressure forces the water from the water main through conduit 42 into serving vessel 38. It is to be understood, however, that a pump or other method can be used to force the fluid through conduit 42 into serving vessel 38.

Conduit 42 follows a path along the exterior of refrigerated chamber 32 and terminates with a spigot 52. It is to be understood, however, that conduit 42 can also be provided within refrigerated chamber 32 so that the fluid carried within conduit 42 is chilled while it is contained therein. Spigot 52 directs the fluid provided by conduit 42 into serving vessel 38.

Figure 2:
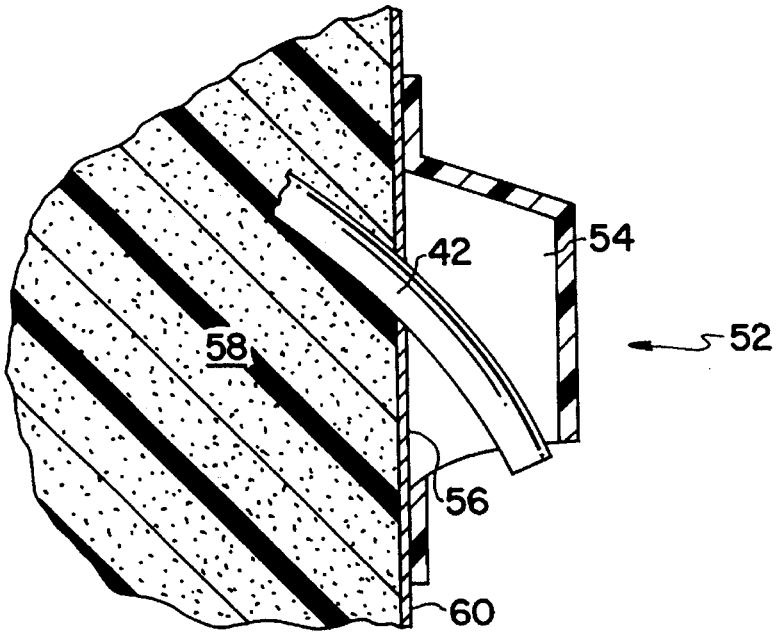
FIG. 2 is a cross sectional view of the spigot illustrated in FIG. 1.

A detailed illustration of one embodiment of spigot 52 is provided in FIG. 2. In this embodiment, spigot 52 includes an injection molded plastic piece 54 attached using convention techniques to the interior wall 56 of refrigerator cabinet 30. An end of conduit 42 is housed within plastic piece 54 and is directed such that fluid is dispensed from the end of conduit 42 at the bottom of plastic piece 54. Alternatively, spigot 52 can include a plastic piece that is directly thermoformed in the liner of the wall of refrigerator cabinet 30. As illustrated in FIG. 2, the wall of cabinet 30 includes polyurethane foam insulation 58 and a liner wall 60 through which conduit 42 is provided. Spigot 52 directs the fluid from conduit 42 into serving vessel 38, which is located directly beneath spigot 52, while preserving the aesthetics of the interior of the refrigerator cabinet.

Referring again to FIG. 1, the fluid supply system also includes a shutoff device for discontinuing or interrupting the supply of fluid to serving vessel 38. In the illustrated embodiment, the shutoff device is a solenoid valve 50 located in conduit 42. In the illustrated embodiment, an inlet of solenoid valve 50 is connected to water main 36 and an outlet of solenoid valve 50 is connected to conduit 42.

In the embodiment illustrated in FIG. 1, a water filter 44 is provided between the inlet of solenoid valve 50 and water main 36. It is to be understood, however, that a variety of water purifying devices and the like may be provided in conjunction with the supply system of the present invention.

As noted above, serving vessel 38 is located within refrigerated chamber 32 on receiving pod 40. In the illustrated embodiment, receiving pod 40 is located on a wall of refrigerated chamber 32. Therefore, when the serving vessel is located on receiving pod 40, serving vessel 38 does not occupy shelf space within refrigerated chamber 32.

In the illustrated embodiment, serving vessel 38 is a water pitcher having a handle 55. In addition, serving vessel 38 is sized so as to be easily carried or transported from refrigerated chamber 32, even when filled. In an exemplary embodiment of the present invention, serving vessel 38 is capable of containing up to three gallons of fluid therein, has a height that is greater than its diameter, a flat bottom surface, an open top, and a spout. Because serving vessel 38 is removable from refrigerated chamber 32, water can be directly dispensed from serving vessel 38 away from the refrigerated chamber. It is to be understood that a variety of different shapes, configurations, and sizes are possible for serving vessel 38.

In the illustrated embodiment, refrigerator cabinet 30 also includes a chilled water and ice dispenser 62 in the exterior portion thereof. Thus, the refrigerated cabinet illustrated in FIG. 1 provides both chilled water and ice from dispenser 62 for filling an individual glass and chilled water from serving vessel 38 for transporting and dispensing a larger quantity of chilled drinking water than is possible using only dispenser 62.

The fluid supply system of the present invention includes a control system that regulates the flow of fluid provided to serving vessel 38. In an exemplary embodiment of the present invention, the control system automatically fills serving vessel 38 so that a predetermined amount of water is substantially always contained therein. Such a control system is illustrated in FIG. 3 and is generally indicated at 70.

Control system 70 includes a plurality of sensing devices for detecting whether predetermined conditions have been satisfied. Examples of these predetermined conditions are provided below. Depending on whether or not these conditions have been satisfied, the water control system opens or closes the shutoff device to interrupt the flow of fluid to the serving vessel. In the illustrated embodiment, as noted above, the shutoff device is a solenoid valve 50. It is to be understood, however, that other valves and methods for interrupting the flow of fluid to the serving vessel are contemplated by the present invention. For example, if a pump is used to provide water from a water supply to the serving vessel. The shutoff device can be the pump itself, i.e., shutting off the pump interrupts the flow of water to the serving vessel.

Figure 3:
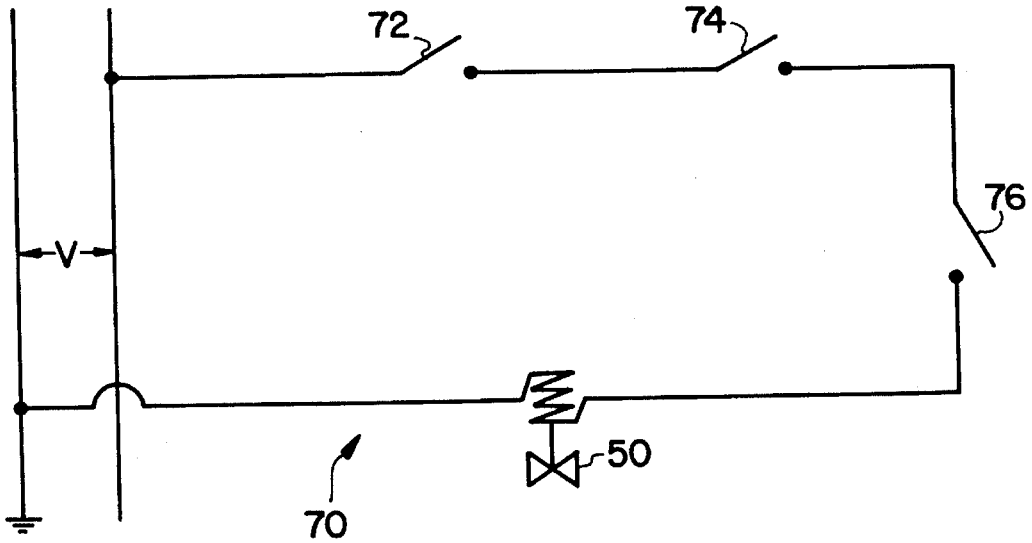
FIG. 3 illustrates a control circuit used to control the water valve illustrated in FIG. 1.

In the embodiment illustrated in FIG. 3, the sensing devices are mechanically actuated switches that are actuated responsive to various predetermined conditions. The switches are connected in series between a power supply V such that when all the switches are closed, current is provided through the solenoid thereby opening solenoid valve 50 and enabling water to flow into serving vessel 38.

Control circuit 70 illustrated in FIG. 3 includes a first switching device which is mechanically actuated by the weight of serving vessel 38 and the contents thereof. As serving vessel 38 fills with water, the weight of serving vessel 38 increases. This weight is detected by the switching device so that the flow of water to the serving vessel is interrupted when this weight reaches a predetermined value. The manner in which the weight is detected by the switching device is discussed below. In the illustrated embodiment, the switching device includes a normally closed switch 72 that is actuated (opened) when the receiving pod has been deflected a predetermined distance.

A second switch 74 is provided which is mechanically actuated when serving vessel 38 is placed on receiving pod 40. Switch 74 is a normally open switch that closes only when serving vessel is properly positioned on the receiving pod.

Finally, control circuit 70 includes a third normally open switch 76 which is mechanically actuated by closure of a door 78 of refrigerator cabinet 30. See FIG. 1. Switch 76 can be, for example, the same switch used to turn on and turn off a refrigerator light when the refrigerator door of a conventional refrigerator cabinet is opened and closed, respectively. When door 78 is open, access is provided to refrigerated chamber 32 and switch 76 is open. Conversely, when door 78 is closed, access to the refrigerated chamber is blocked and switch 76 is closed. Thus, third switch 76 prevents filling of serving vessel 38 whenever the refrigerator door is open.

In a preferred embodiment of the present invention, switches 72, 74 and 76 are all button-type switches and solenoid valve 50 is the same type of solenoid water valve used for controlling the flow of water to chilled water and ice dispenser 62. When all three switches are closed, i.e., when the weight of the serving vessel and contents contained therein is not sufficient to deflect receiving pod 40, the refrigerator door is closed and the serving vessel is located on the receiving pod, solenoid valve 50 is actuated and water is provided to the serving vessel.

Figure 4:
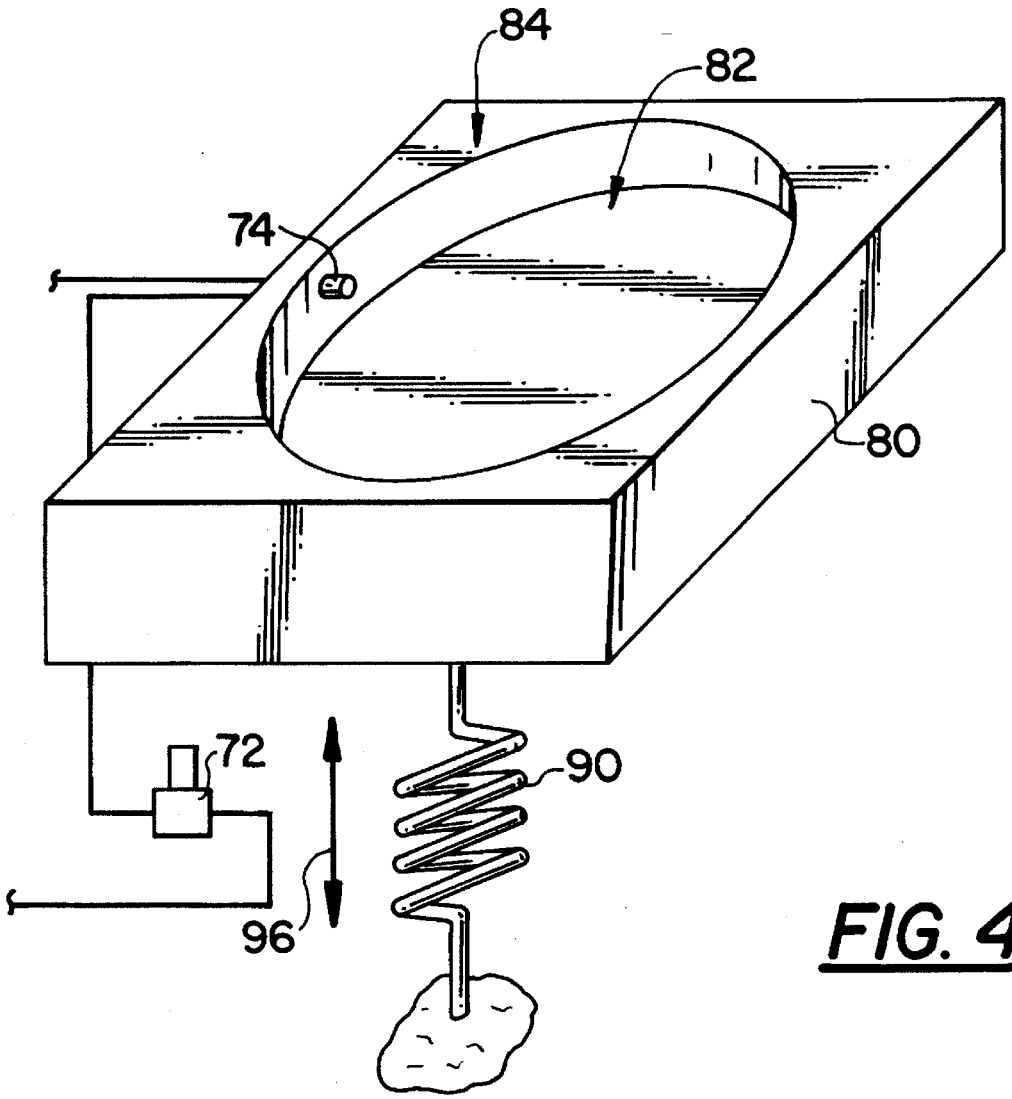
FIG. 4 is a perspective view of a receiving pod used in the system for providing a supply of chilled fluid according to the present invention.

A more detailed illustration of a receiving pod 80 according to one embodiment of the present invention is illustrated in FIG. 4. As shown in this FIGURE, receiving pod 80 is designed so as to receive the bottom portion of serving vessel 38 thereon. A recess 82 is provided on an upper surface 84 of receiving pod 80. Recess 82 has a circumferential diameter that is slightly larger than the diameter of the base of serving vessel 38. Furthermore, recess 82 is shaped so as to substantially correspond to the shape of the base of serving vessel 38. By matching the size and shape of the bottom portion of serving vessel 38, receiving pod 80 more securely holds serving vessel 38 to prevent accidental spills and also serves as a positioning device for accurately positioning serving vessel 38 directly under spigot 52.

As illustrated in FIG. 4, second switch 74 is provided on a wall of recess 82 so that switch 74 is actuated by contacting serving vessel 38. Placing second switch 74 is this location ensures that switch 74 is only actuated (closed) when serving vessel 38 is properly positioned within recess 82 on receiving pod 80. Thus, second switch 74 prevents accidental spills caused by actuation of the solenoid water valve when the serving vessel 38 is not properly positioned receiving pod 80.

As discussed above, the control system of the present invention discontinues the supply of water to the serving vessel when the weight of the serving vessel and its contents reaches a predetermined amount. As a result, the volume of water within serving vessel 38 is generally maintained at a predetermined minimum value. In the embodiment illustrated in FIG. 4, a calibrated spring 90 is positioned under receiving pod 80 so that the weight of receiving pod 80, serving vessel 38, and the contents of serving vessel 38 deflect calibrated spring 90. The relative movement of receiving pod 80 is indicated by arrow 96 in FIG. 4. When the receiving pod 80 has been deflected a predetermined distance, receiving pod 80 contacts switch 72 causing switch 72 to open, thus, preventing current from flowing through solenoid valve 50 and interrupting the flow of water to serving vessel 38. In this manner, the control system detects when the volume of liquid contained within serving vessel 38 falls below a predetermined minimum value, i.e., when the combined weight of the receiving pod, serving vessel and contents thereof are insufficient to maintain switch 72 in the actuated or open position, and actuates the solenoid valve 50 to provide more fluid to the serving vessel. Thus, the volume of fluid contained within serving vessel 38 is maintained generally constant.

While the switching device in the illustrated embodiment of the present invention detects the weight of the receiving pod, serving vessel, and the contents contained therein using a calibrated spring that deflects a greater distance as the weight and hence volume of fluid in the serving vessel increases, it is to be understood that other switching devices can be used to detect the weight of the serving vessel and its contents and to deactivate the solenoid valve accordingly. For example, at least one pressure sensitive switch can be located directly on the surface of recess 82 below serving vessel 38 so that the pressure sensitive switch detects the weight of the serving vessel without the need for pod 80 to move. Alternatively, the pressure sensitive switch can be place under the receiving pod so that it detects the weight of the receiving pod and serving vessel without the need for the calibrated spring. The pressure sensitive switch outputs a signal when the weight of the serving vessel and its contents reach a predetermined valve. Such a system for detecting the weight of the serving vessel and its contents has the advantage that there are fewer moving parts than the system illustrated in FIG. 4.

It is to be further understood that other systems can be used to detect when the volume of fluid in serving vessel 38 reaches the predetermined value. For example, a float can be provided within serving vessel 38. The float actuates a switch when the water level in the serving vessel reaches a predetermined weight. However, positioning the float within the serving vessel each time the serving vessel is replaced in the refrigerated chamber may be cumbersome.

Figure 5:
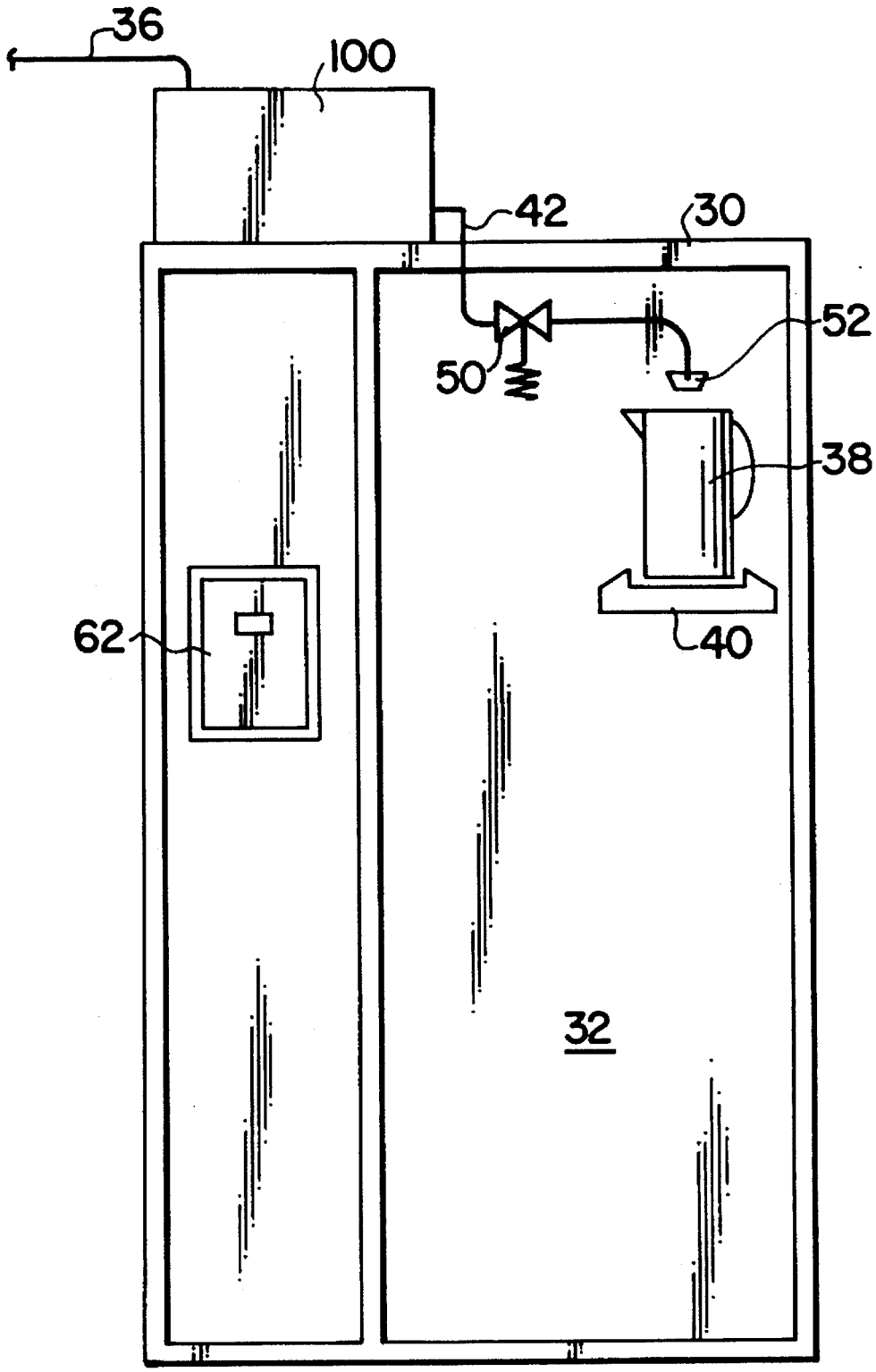
FIG. 5 illustrates another embodiment of a system for providing a supply of chilled fluid according to the principles of the present invention.

Another embodiment of a system for providing a supply of chilled water in accordance with the invention is illustrated in FIG. 5. In this embodiment, a reservoir 100 is provided outside refrigerated chamber 32. Reservoir 100 is capable of receiving a large quantity of fluid therein. Conduit 42 transports the fluid from reservoir 100 to serving vessel 38. Because reservoir 100 is located above spigot 52, gravity provides a sufficient pressure for the fluid within reservoir 100 to flow into serving vessel 38. However, it is to be understood that a pump may also be provided for pumping the fluid from reservoir 100 to serving vessel 38. It is also possible to locate reservoir 100 within the refrigerated chamber thereby increasing the volume of chilled fluid that is readily available even if the all of the fluid in serving vessel 38 has been used up.

In the illustrated embodiment, solenoid valve 50 is provided in conduit 42 for controlling the flow of fluid from reservoir 100 to serving vessel 38. It is to be understood that if a pump is provided for pumping water from reservoir 100 to serving vessel 38, the pump can be controlled in the same manner as the solenoid valve 50 so that the solenoid valve can be eliminated.

While the present invention has been described above with reference to a system that provides drinking water to the serving vessel, it is to be understood that the present invention is not limited to providing only drinking water. Other fluids, such as juices or other refreshments, can be used in conjunction with the present invention.

While the invention has been described in connection with what is presently considered to be the most practical and preferred embodiments, it to be understood that the invention is not to be limited to the disclosed embodiments, but on the contrary is intended to cover various modifications and equivalent arrangements included within the spirit and scope of the appended claims.

What is claimed is:

1. A system for providing a supply of chilled fluid, said system comprising:

a refrigerator cabinet having a refrigerated food storage area capable of storing a plurality of different solid food items and a door for accessing said refrigerated food storage area;

a serving vessel removably located within said refrigerated food storage area for containing fluid therein such that said fluid within said serving vessel is chilled when said serving vessel is located within said refrigerated food storage area, said serving vessel also permitting said fluid to be conveniently transported outside said refrigerated food storage area in said serving vessel for selectively dispensing said fluid from said serving vessel;

a first sensing means for sensing whether said door is open;

a second sensing means for sensing whether said serving vessel is at a predetermined location within said refrigerated food storage area;

a third sensing means for sensing an amount of fluid contained in said serving vessel, a fluid supply system providing said fluid to said serving vessel via a dispenser located in said food storage area in response to outputs from said first sensing means, said second sensing means, and said third sensing means.

2. A system as defined in claim 1, wherein said fluid supply system automatically fills said serving vessel with said fluid when said amount of fluid in said vessel detected by said third sensing means falls below a threshold level so that a predetermined amount of fluid is maintained in said serving vessel.

3. A system as defined in claim 1, further comprising a receiving pod located within said food storage area, said receiving pod being sized so as to receive said serving vessel thereon, said fluid supply system automatically discontinuing said supply of fluid to said serving vessel when said second sensing means detects that said serving vessel is removed from said receiving pod.

4. A system as defined in claim 1, wherein said third sensing means senses a weight of said serving vessel and any contents therein, said fluid supply system automatically filling said serving vessel if said weight of said serving vessel and said contents falls below a predetermined value.

5. A system as defined in claim 1, wherein said fluid supply system automatically discontinues said supply of fluid to said serving vessel if said first sensing means detects that said door is opened.

6. A system as defined in claim 1, wherein said food storage area is defined by a plurality of walls, said fluid is water and said fluid supply system includes:

a water supply source; and a water conduit directing said water from said water supply source to said dispenser.

7. A system as defined in claim 6, wherein said first sensing means includes a first mechanical switch which actuates in response to movement of said door so that said flow of fluid to said serving vessel is cut off when said door is opened.

8. A system as defined in claim 7, further comprising a receiving pod located in said food storage area and sized so as to receive said serving vessel thereon, and wherein said second sensing means includes a second mechanical switch which actuates in response to positioning of said serving vessel on said receiving pod so that said flow of fluid is cut off when said serving vessel is removed from said receiving pod.

9. A system as defined in claim 8, wherein said third sensing means includes a calibrated spring and a third mechanical switch which is actuated when a weight of said serving vessel and contents contained therein overcomes a force of said calibrated spring thereby deflecting said calibrated spring a predetermined distance.

10. A system as defined in claim 9, wherein said serving vessel is a pitcher having a handle portion and adapted to contain up to 3 gallons of said fluid therein so that said pitcher can be conveniently carried outside said food storage area.

11. A system as defined in claim 1, wherein said fluid supply system includes a solenoid valve which is actuated to control fluid flow though said dispenser, and a control system for actuating said solenoid valve based on said outputs of said first sensing means, said second sensing means, and said third sensing means.

12. A system as defined in claim 1, wherein said serving vessel is a pitcher having a handle portion and adapted to contain up to 3 gallons of fluid therein so that said patcher can be conveniently carried outside said food storage area.

13. A system for providing a supply of chilled fluid, said system comprising:

a refrigerator cabinet having a refrigerated food storage area capable of storing a plurality of different solid food items and a door for accessing said refrigerated food storage area;

dispensing means for dispensing fluid into a serving vessel removably located within said refrigerated food storage area first sensing means for sensing whether said door is open;

second sensing means for sensing whether said serving vessel is at a predetermined location within said refrigerated food storage area;

third sensing means for sensing an amount of fluid contained in said serving vessel, fluid controlling means, receiving outputs of said first, said second, and said third sensing means, for immediately and automatically causing said dispensing means to provide said fluid to said serving vessel if said serving vessel is located at said predetermined location, said door is closed, and said amount of fluid contained in said serving vessel is below a predetermined threshold amount.

* * * * *